US007162766B1

(12) United States Patent
Yakopcic

(10) Patent No.: US 7,162,766 B1
(45) Date of Patent: Jan. 16, 2007

(54) GOLF CLUB HEAD CLEANING DEVICE

(76) Inventor: John Yakopcic, 204 Clubview Dr., Mc Murray, PA (US) 15317

( * ) Notice: Subject to any disclaimer, the term of this patent is extended or adjusted under 35 U.S.C. 154(b) by 364 days.

(21) Appl. No.: 10/782,106

(22) Filed: Feb. 19, 2004

(51) Int. Cl.
*A46B 11/00* (2006.01)
*A63B 57/00* (2006.01)

(52) U.S. Cl. ..... 15/104.92; 15/160; 401/4; 401/9; 401/10

(58) Field of Classification Search ..... 15/104.92, 15/160; 401/4, 9–11
See application file for complete search history.

(56) References Cited

U.S. PATENT DOCUMENTS 3,583,018 A * 6/1971 Fink ..... 15/104.92
4,821,358 A * 4/1989 Wyckoff et al. ..... 15/104.92
D386,847 S 11/1997 Petrie
5,732,435 A * 3/1998 Williams et al. ..... 15/104.92
5,787,539 A 8/1998 Nussbaum
6,317,916 B1 * 11/2001 Smith ..... 15/104.92
6,430,770 B1 8/2002 Glass
6,745,424 B1 * 6/2004 Pimentel et al. ..... 15/21.2

FOREIGN PATENT DOCUMENTS

JP 11-70203 * 3/1999

* cited by examiner

*Primary Examiner*—Mark Spisich

(57) ABSTRACT

A golf club head cleaning device for cleaning dirt and grass from the head of a golf club. The golf club head cleaning device includes a container member being designed for receiving a cleaning solution. A lid member is selectively coupled to the container member. The lid member comprises a slot extending through the lid member. The slot is designed for permitting the head of the golf club to be inserted into the container member to allow the cleaning solution to be agitated by a user to remove dirt and grass from the head of the golf club.

13 Claims, 3 Drawing Sheets

34
30
26
26
15
28
28
32
14
16
18
20
12
22
24

GOLF CLUB HEAD CLEANING DEVICE

BACKGROUND OF THE INVENTION

1. Field of the Invention

The present invention relates to golf club cleaners and more particularly pertains to a new golf club head cleaning device for cleaning dirt and grass from the head of a golf club.

2. Description of the Prior Art

The use of golf club cleaners is known in the prior art. U.S. Pat. No. 6,430,770 describes a device for scrubbing the head of a golf club. Another type of golf club cleaner is U.S. Pat. No. 5,787,539 having a device for spraying cleaning fluid onto a head of a golf club and a brush for brushing the head of the golf club. U.S. Pat. No. Des. 386,847 shows a golf club cleaner.

While these devices fulfill their respective, particular objectives and requirements, the need remains for a device that has certain improved features that allows the agitation of the cleaning solution to clean the head of the golf club.

SUMMARY OF THE INVENTION

The present invention meets the needs presented above by providing a container member that has a bag portion comprising a flexible material allowing the bag portion to be manipulated to agitate the cleaning solution in the bag portion.

Still yet another object of the present invention is to provide a new golf club head cleaning device that provides and agitator member positioned in the bag portion to facilitate agitation of the cleaning solution in the bag portion.

Even still another object of the present invention is to provide a new golf club head cleaning device that provides a scrubbing member being positioned adjacent the slot in the lid member to scrub the head of the golf club when the head of the golf club is passing through the slot in the lid member.

To this end, the present invention generally comprises a container member being designed for receiving a cleaning solution. A lid member is selectively coupled to the container member. The lid member comprises a slot extending through the lid member. The slot is designed for permitting the head of the golf club to be inserted into the container member to allow the cleaning solution to be agitated by a user to remove dirt and grass from the head of the golf club.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
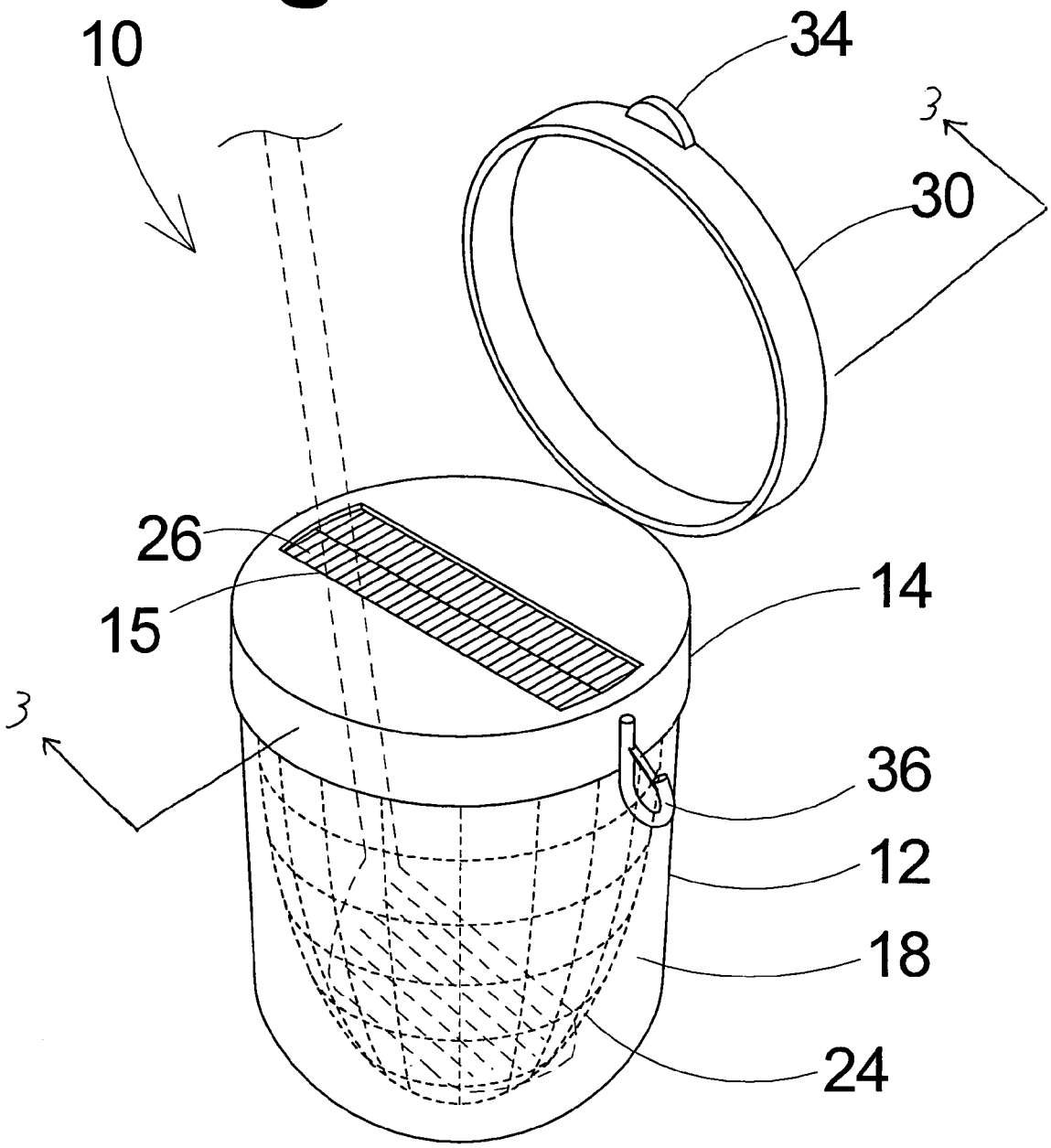
FIG. 1 is a perspective view of a new golf club head cleaning device according to the present invention shown in use.
Figure 2:
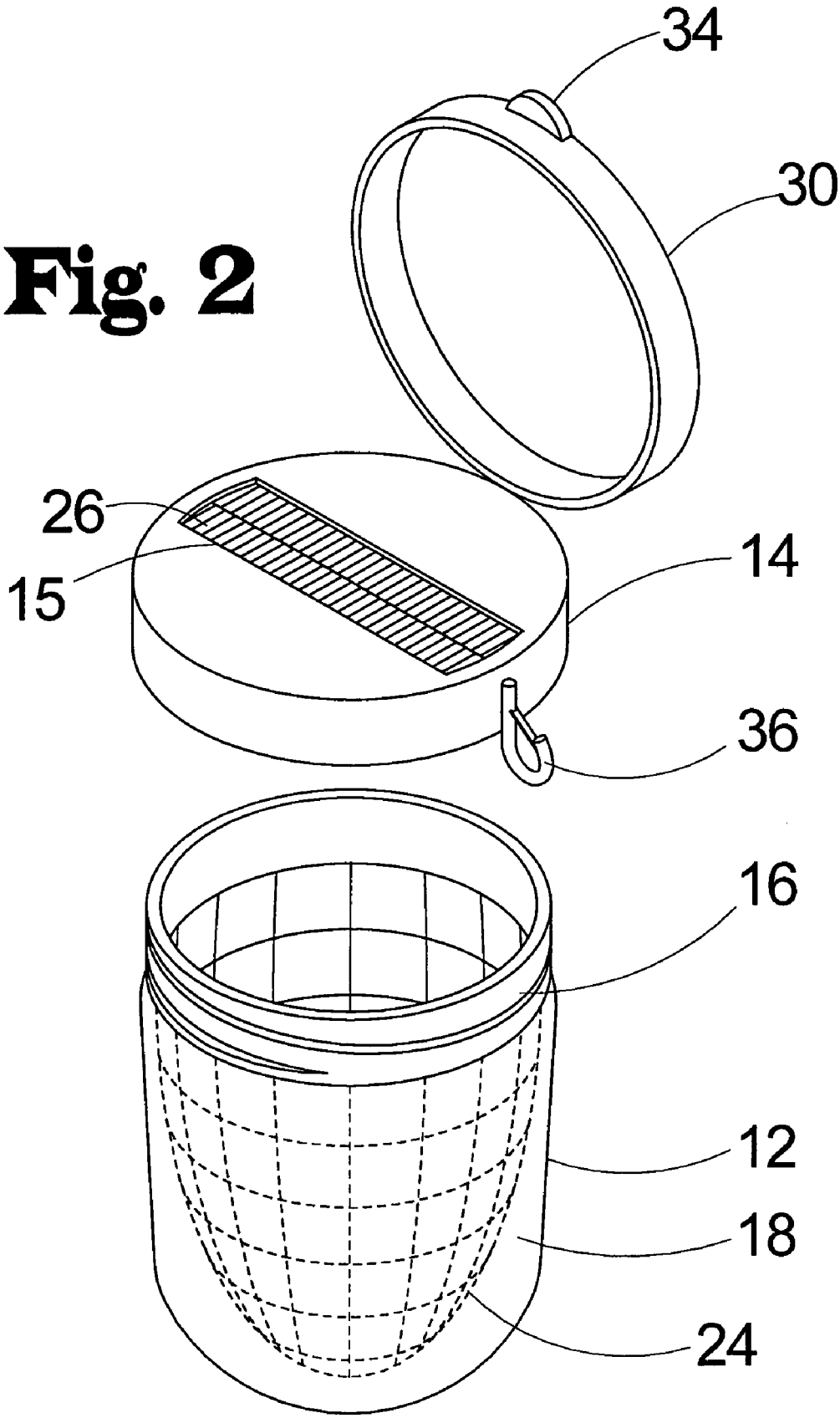
FIG. 2 is an exploded perspective view of the present invention.
Figure 3:
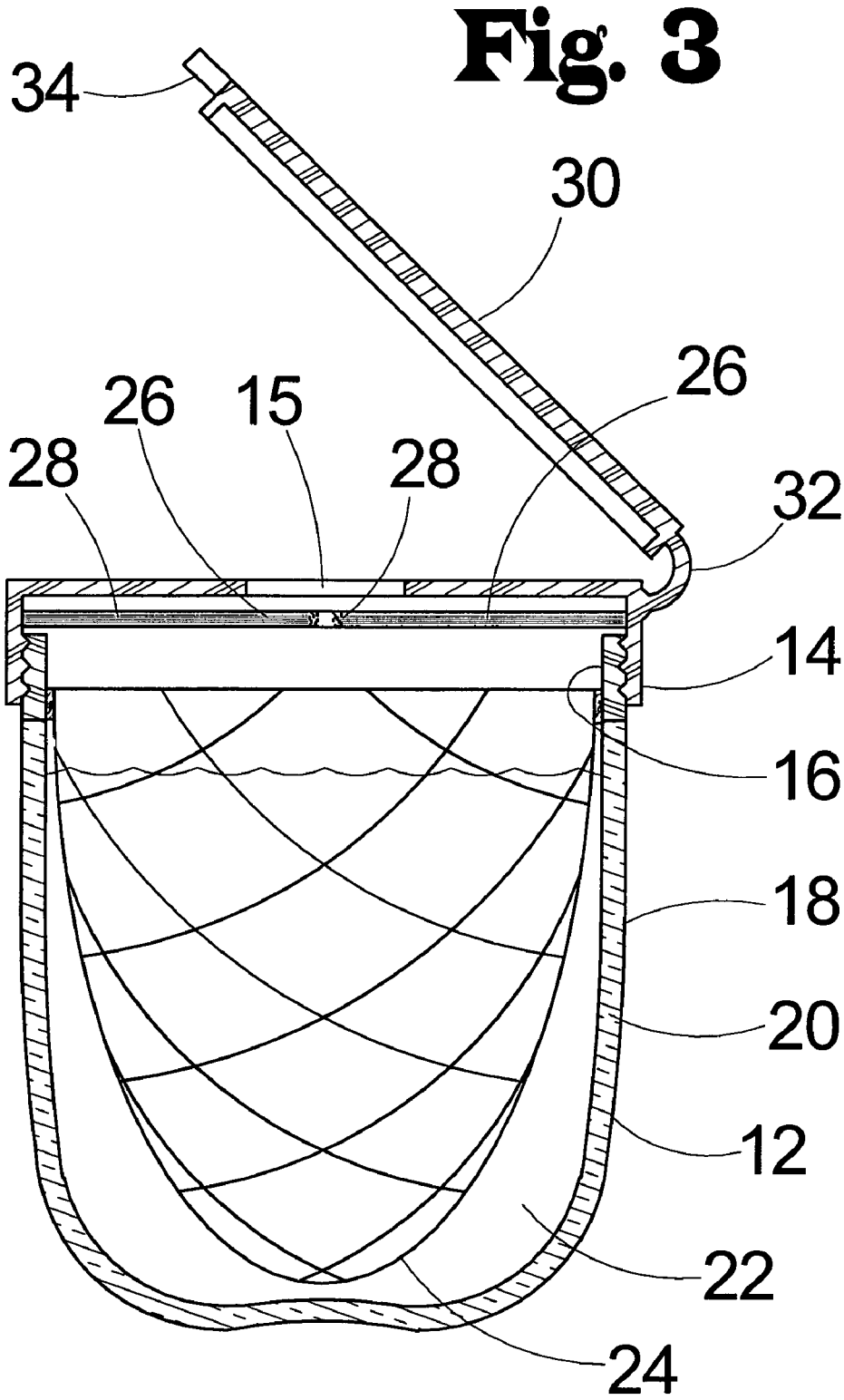
FIG. 3 is a cross-sectional view of the present invention taken along line 3—3 of FIG. 1.

With reference now to the drawings, and in particular to FIGS. 1 through 3 thereof, a new golf club head cleaning device embodying the principles and concepts of the present invention and generally designated by the reference numeral 10 will be described.

As best illustrated in FIGS. 1 through 3, the golf club head cleaning device 10 generally comprises a container member 12 being designed for receiving a cleaning solution.

A lid member 14 is selectively coupled to the container member 12. The lid member 14 comprises a slot 15 extending through the lid member 14. The slot 15 is designed for permitting the head of the golf club to be inserted into the container member 12 to allow the cleaning solution to be agitated by a user to remove dirt and grass from the head of the golf club.

The container member 12 comprises a connector portion 16 and a bag portion 18. The bag portion 18 is coupled to the connector portion 16 whereby the bag portion 18 is suspended from the connector portion 16. The connector portion 16 is selectively coupled to the lid member 14 to suspend the bag portion 18 form the lid member 14. The bag portion 18 of the container member 12 is designed for receiving the cleaning solution whereby the bag portion 18 receives the head of the golf club to allow the cleaning solution to clean the head of the golf club when the head of the golf club is inserted through the slot 15 in the lid member 14.

The bag portion 18 of the container member 12 comprises a perimeter wall 20. The perimeter wall 20 defines an interior space 22 of the bag portion 18. The interior space 22 is designed for receiving the cleaning solution whereby the perimeter wall 20 is for containing the cleaning solution. The bag portion 18 is designed for receiving the head of the golf club to allow the head of the golf club to be inserted into the cleaning solution in the bag portion 18.

The perimeter wall 20 of the bag portion 18 comprises a flexible material. The flexible material is designed for being manipulated by a hand of a user whereby the bag portion 18 is for agitating the cleaning solution to clean the head of the golf club when the bag portion 18 is manipulated by the user.

An agitator member 24 is coupled to the container member 12. The agitator member 24 is positioned in the bag portion 18 of the container member 12 whereby the agitator member 24 is positioned in the cleaning solution in the container member 12. The agitator member 24 is designed for facilitating agitation of the cleaning solution to clean the dirt and grass from the head of the golf club when the cleaning solution is agitated by the user.

The agitator member 24 comprises a mesh material. The mesh material is designed for permitting the cleaning solution to pass through the agitator member 24 to agitate the cleaning solution to clean the head of the golf club when the cleaning solution is agitated by the user.

At least one scrubbing member 26 is coupled to the lid member 14. The scrubbing member 26 is positioned adjacent the slot 15 of the lid member 14. The scrubbing member 26 is designed for engaging the head of the golf club to scrape dirt and grass from the head of the golf club when the head of the golf club passes through the slot 15 of the lid member 14.

The scrubbing member 26 comprises a plurality of bristles 28. The bristles 28 are coupled to the lid member 14 whereby the bristles 28 extend under the slot 15 in the lid member 14. Each of the bristles 28 is designed for engaging the head of the golf club to scrub the dirt and grass from the head of the golf club when the head of the golf club is passed through the slot 15 in the lid member 14.

A cover member 30 is pivotally coupled to the lid member 14. The cover member 30 is selectively pivoted to engage the lid member 14 whereby the cover member 30 is positioned over the slot 15 of the lid member 14. The lid member 14 is for selectively closing the slot 15 of the lid member 14 to inhibit the cleaning solution in the container member 12 from being inadvertently spilled from the slot 15 in the lid member 14. The cover member 30 is selectively pivoted away from the lid member 14 to allow the head of the golf club to be inserted into the slot 15 of the lid member 14.

A tether member 32 is coupled between the lid member 14 and the cover member 30. The tether member 32 is for permitting the cover member 30 to pivot with respect to the lid member 14.

A tab member 34 is selectively coupled to the cover member 30 whereby the tab member 34 extends outwardly from the cover member 30. The tab member 34 is designed for being engaged by the user to facilitate disengaging the cover member 30 from the lid member 14 to permit pivoting of the cover member 30 with respect to the lid member 14.

A clip member 36 is coupled to the lid member 14 whereby the clip member 36 is positioned on a perimeter of the lid member 14. The clip member 36 is designed for being selectively coupled to a golf bag to allow the lid member 14 and the container member 12 to be transported with the golf bag.

In use, the user removed the lid member 14 from the container member 12 and pours the cleaning solution into the bag portion 18 of the container member 12. The lid member 14 is coupled back onto the container member 12. The head of the golf club is inserted into the slot 15 of the lid member 14 and into the bag portion 18 of the container member 12. The bag portion 18 is manipulated by the user to agitate the cleaning solution in the bag portion 18 to clean the dirt and grass from the head of the golf club. As the head of the golf club is being withdrawn from the slot 15 in the lid member 14 the bristles 28 of the scrubbing member 26 engages the golf club and scrubs any left over dirt and grass from the head of the golf club. The user the dries the golf club with a towel. The cover member 30 is then pivot over the slot 15 and engaged to the lid member 14 to inhibit the cleaning solution from spilling through the slot 15 in the lid member 14. The clip member 36 is then selectively coupled to the golf bag to be ready for the user to clean another head of a golf club.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf club head cleaning device for cleaning the head of a golf club, the golf club head cleaning device comprising:

a container member for receiving a cleaning solution;

a lid member being selectively coupled to said container member, said lid member comprising a slot extending through said lid member, said slot permitting the head of the golf club to be inserted into said container member to contact the cleaning solution when the cleaning solution is received in the container member; and an agitator member for facilitating agitation of the cleaning solution, said agitator member being positioned in said container member such that said agitator member is positioned in the cleaning solution when said container member contains cleaning solution, said agitator member comprising a plurality of meshed elements defining a plurality of openings in said agitator member.

2. The golf club head cleaning device as set forth in claim 1, further comprising:

said container member comprising a connector portion and a bag portion, said bag portion being coupled to said connector portion such that said bag portion is suspended from said connector portion, said connector portion being selectively coupled to said lid member to suspend said bag portion from said lid member, said bag portion of said container member being adapted for receiving the cleaning solution such that said bag portion receives the head of the golf club to allow the cleaning solution to clean the head of the golf club when the head of the golf club is inserted through the slot in said lid member.

3. The golf club head cleaning device as set forth in claim 2, further comprising:

said bag portion of said container member comprising a perimeter wall, said perimeter wall defining an interior space of said bag portion, said interior space being adapted for receiving the cleaning solution such that said perimeter wall is for containing the cleaning solution, said bag portion is adapted for receiving the head of the golf club to allow the head of the golf club to be inserted into the cleaning solution in said bag portion.

4. The golf club head cleaning device as set forth in claim 3, further comprising:

said perimeter wall of said bag portion comprising a flexible material, said flexible material being adapted for being manipulated by a hand of a user such that said bag portion is for agitating the cleaning solution to clean the head of the golf club when said bag portion is manipulated by the user.

5. The golf club head cleaning device as set forth in claim 1, wherein the agitator member has a width, the width of the agitator member tapering narrower at locations away from the lid member.

6. The golf club head cleaning device as set forth in claim 1, further comprising:

at least one scrubbing member being coupled to said lid member, said scrubbing member being positioned adjacent said slot of said lid member, said scrubbing member being adapted for engaging the head of the golf club to scrape dirt and grass from the head of the golf club when the head of the golf club passes through said slot of said lid member.

7. The golf club head cleaning device as set forth in claim 6, further comprising:

said scrubbing member comprising a plurality of bristles, said bristles being coupled to said lid member such that said bristles extend under said slot in said lid member, each of said bristles being adapted for engaging the head of the golf club to scrub the dirt and grass from the head of the golf club when the head of the golf club is passed through said slot in said lid member.

8. The golf club head cleaning device as set forth in claim 1, further comprising:

a cover member being pivotally coupled to said lid member, said cover member being selectively pivoted to engage said lid member such that said cover member is positioned over said slot of said lid member, said lid member being for selectively closing said slot of said lid member to inhibit the cleaning solution in said container member from being inadvertently spilled from said slot in said lid member, said cover member being selectively pivoted away from said lid member to allow the head of the golf club to be inserted into said slot of said lid member.

9. The golf club head cleaning device as set forth in claim 8, further comprising:

a tether member being coupled between said lid member and said cover member, said tether member being for permitting said cover member to pivot with respect to said lid member.

10. The golf club head cleaning device as set forth in claim 8, further comprising:

a tab member being selectively coupled to said cover member such that said tab member extends outwardly from said cover member, said tab member being adapted for being engaged by the user to facilitate disengaging said cover member from said lid member to permit pivoting of said cover member with respect to said lid member.

11. The golf club head cleaning device as set forth in claim 1, further comprising:

a clip member being coupled to said lid member such that said clip member is positioned on a perimeter of said lid member, said clip member being adapted for being selectively coupled to a golf bag to allow said lid member and said container member to be transported with the golf bag.

12. A golf club head cleaning device for cleaning the head of a golf club, the golf club head cleaning device comprising:

a container member being adapted for receiving a cleaning solution; and a lid member being selectively coupled to said container member, said lid member comprising a slot extending through said lid member, said slot being adapted for permitting the head of the golf club to be inserted into said container member to allow the cleaning solution to be agitated by a user to remove dirt and grass from the head of the golf club;

an agitator member being coupled to said container member, said agitator member being positioned in said container member such that said agitator member is positioned in the cleaning solution in said container member, said agitator member being adapted for facilitating agitation of the cleaning solution to clean the dirt and grass from the head of the golf club when the cleaning solution is agitated by the user; and said agitator member comprising a mesh material, said mesh material being adapted for permitting the cleaning solution to pass through said agitator member to agitate the cleaning solution to clean the head of the golf club when the cleaning solution is agitated by the user.

13. A golf club head cleaning device for cleaning the head of a golf club, the golf club head cleaning device comprising:

a container member being adapted for receiving a cleaning solution;

a lid member being selectively coupled to said container member, said lid member comprising a slot extending through said lid member, said slot being adapted for permitting the head of the golf club to be inserted into said container member to allow the cleaning solution to be agitated by a user to remove dirt and grass from the head of the golf club, said container member comprising a connector portion and a bag portion, said bag portion being coupled to said connector portion such that said bag portion is suspended from said connector portion, said connector portion being selectively coupled to said lid member to suspend said bag portion from said lid member, said bag portion of said container member being adapted for receiving the cleaning solution such that said bag portion receives the head of the golf club to allow the cleaning solution to clean the head of the golf club when the head of the golf club is inserted through the slot in said lid member;

said bag portion of said container member comprising a perimeter wall, said perimeter wall defining an interior space of said bag portion, said interior space being adapted for receiving the cleaning solution such that said perimeter wall is for containing the cleaning solution, said bag portion is adapted for receiving the head of the golf club to allow the head of the golf club to be inserted into the cleaning solution in said bag portion;

said perimeter wall of said bag portion comprising a flexible material, said flexible material being adapted for being manipulated by a hand of a user such that said bag portion is for agitating the cleaning solution to clean the head of the golf club when said bag portion is manipulated by the user;

an agitating member being coupled to said container member, said agitator member being positioned in said bag portion of said container member such that said agitator member is positioned in the cleaning solution in said container member, said agitator member being adapted for facilitating agitation of the cleaning solution to clean the dirt and grass from the head of the golf club when the cleaning solution is agitated by the user;

said agitator member comprising a mesh material, said mesh material being adapted for permitting the cleaning solution to pass through said agitator member to agitate the cleaning solution to clean the head of the golf club when the cleaning solution is agitated by the user;

at least one scrubbing member being coupled to said lid member, said scrubbing member being positioned adjacent said slot of said lid member, to scrape dirt and grass from the head of the golf club when the head of the golf club passes through said slot of said lid member;

said scrubbing member comprising a plurality of bristles, said bristles being coupled to said lid member such that said bristles extend under said slot in said lid member, each of said bristles being adapted for engaging the head of the golf club to scrub the dirt and grass from the head of the golf club when the head of golf club is passed through said slot in said lid member;

a cover member being pivotally coupled to said lid member, said cover member being selectively pivoted to engage said lid member such that said cover member is positioned over said slot of said lid member, said lid member being for selectively closing said slot of said lid member to inhibit the cleaning solution in said container member from being inadvertently spilled from said slot in said lid member, said cover member being selectively pivoted away from said lid member to allow the head of the golf club to be inserted into said slot of said lid member;

a tether member being coupled between said lid member and said cover member, said tether member being for permitting said cover member to pivot with respect to said lid member;

a tab member being selectively coupled to said cover member such that said tab member extends outwardly from said cover member, said tab member being adapted for being engaged by the user to facilitate disengaging said cover member from said lid member to permit pivoting of said cover member with respect to said lid member; and a clip member being coupled to said lid member such that said clip member is positioned on a perimeter of said lid member, said clip member being adapted for being selectively coupled to a golf bag to allow said lid member and said container member to be transported with the golf bag.

* * * * *